US011692758B2

(12) United States Patent
Kuppusamy et al.

(10) Patent No.: US 11,692,758 B2
(45) Date of Patent: Jul. 4, 2023

(54) SLIDING DRAIN PANS FOR COOLING UNITS

(71) Applicant: Heatcraft Refrigeration Products LLC, Richardson, TX (US)

(72) Inventors: Karthick Kuppusamy, Salem (IN); Vignesh Thiyagarajan, Tamilnadu (IN)

(73) Assignee: Heatcraft Refrigeration Products LLC, Richardson, TX (US)

( * ) Notice: Subject to any disclaimer, the term of this patent is extended or adjusted under 35 U.S.C. 154(b) by 318 days.

(21) Appl. No.: 16/920,339

(22) Filed: Jul. 2, 2020

(65) Prior Publication Data

US 2022/0003484 A1 Jan. 6, 2022

(51) Int. Cl.
*F25D 21/14* (2006.01)
*F24F 13/22* (2006.01)

(52) U.S. Cl.
CPC ..... *F25D 21/14* (2013.01); *F24F 13/222* (2013.01); *F25D 2321/145* (2013.01); *F25D 2321/1442* (2013.01)

(58) Field of Classification Search
CPC ..... F25D 21/14; F25D 2321/1442; F25D 2321/145; F24F 13/222
See application file for complete search history.

(56) References Cited

U.S. PATENT DOCUMENTS

2014/0110088 A1* 4/2014 Collins ..... F25D 17/067 165/121

FOREIGN PATENT DOCUMENTS

CN 208124462 U * 11/2018 ..... F24F 1/0007
CN 114521499 A * 5/2022

OTHER PUBLICATIONS

CN-208124462-U translation.*
CN-114521499-A translation.*

* cited by examiner

*Primary Examiner* — Elizabeth J Martin
(74) *Attorney, Agent, or Firm* — Johnston IP Law, PLLC

(57) ABSTRACT

In one instance, a cooling unit for use as an aspect of a cooling system includes a cabinet having a plurality of panels and having an interior, a front face with a fan aperture formed in the front face, and a bottom panel. The cooling unit further includes a drain pan below the bottom panel. The cooling unit also includes a plurality of guide-rail slide and track assemblies coupled between at least a portion of the cabinet and the drain pan for providing controlled movement of the drain pan between an operational position and a maintenance position. Other cooling units are disclosed with drain pans that may be lowered by a single technician.

20 Claims, 9 Drawing Sheets

SLIDING DRAIN PANS FOR COOLING UNITS

TECHNICAL FIELD

This application is directed, in general, to cooling units for refrigerated spaces, and more specifically, to sliding drain pans for cooling units.

BACKGROUND

The following discussion of the background is intended to facilitate an understanding of the present disclosure only. It should be appreciated that the discussion is not an acknowledgement or admission that any of the material referred to was part of the common general knowledge at the priority date of the application.

Refrigeration systems, e.g., a commercial unit cooler, or other heating ventilating and cooling (HVAC) systems come in many sizes and shapes. One application is a refrigerated storeroom, walk-in unit, or cold storage. Such systems include a drain pan that is positioned underneath the cooling unit to collect any water that results from the cooling process. Maintenance is required on the HVAC systems at times.

SUMMARY

According to an illustrative embodiment, a cooling unit for cooling a refrigerated room includes a cabinet having a plurality of panels forming an interior space and an evaporator coil disposed within the interior space. The plurality of panels include a bottom panel and a front panel. The cooling unit further includes a fan aperture formed in the front panel of the cabinet for allowing discharge of an airflow, and further including a drain pan. The drain pan is at least within three inches of the bottom panel of the plurality of panels of the cabinet when in an operational position. The cooling unit also includes a plurality of guide-rail slides and tracks coupled to the drain pan and to another portion of the cabinet.

The guide-rail slides and tracks are configured to allow limited relative movement of the drain pan between the operational position and a maintenance position. In the maintenance position the drain pan is at least ten inches from the bottom panel of the cabinet. The cooling unit further includes at least one telescoping gas spring coupled at a first end to the drain pan and at the other end to a portion of the cabinet and that is configured to allow the drain pan to move between the operational position and the maintenance position slower than it otherwise would. The air cooler also includes at least one selectably releasable fastener coupled to the drain pan and another portion of the cabinet to hold the drain pan proximate the cabinet when in the operational position and to be released to allow the drain pan to move on the guide rail slides to the maintenance position. A distance traveled by the drain pan in going from the operational position to the maintenance position is at least ten inches.

According to another illustrative embodiment, a cooling unit for cooling a walk-in cooler includes a cabinet. A plurality of vertical side panels, a top panel, and a bottom panel are coupled to form the cabinet. One of the plurality of vertical side panels is formed with a fan aperture and a fan is disposed proximate the fan aperture. The air cooler further includes a heat exchanger disposed within the cabinet such that an airflow moved by the fan interacts with the heat exchanger before being discharged from the cabinet through the fan aperture. The air cooler further includes a drain pan positioned underneath and proximate to the bottom panel when in an operational position and a plurality of guide-rail slide and track assemblies cooperatively coupled to the drain pan and to the cabinet to provide vertical movement of the drain pan relative to the cabinet between the operational position and a maintenance position in which the drain pan is at least twelve inches from the bottom panel. The air cooler also includes at least one fastener for selectively holding the drain pan in the operational position when fastened, and includes a gas spring coupled to the cabinet and to the drain pan for providing controlled movement of the drain pan relative to the bottom panel between the operational position and maintenance position.

According to still another illustrative embodiment, a cooling unit for use as an aspect of a cooling system includes a cabinet having a plurality of panels and having an interior, a front face with a fan aperture formed in the front face, and a bottom panel. The cooling unit further includes an evaporator coil disposed within the interior of the cabinet and a drain pan below the bottom panel. The drain pan has a drain for coupling to a drain line. The cooling unit also includes a plurality of guide-rail slide and track assemblies coupled between at least a portion of the cabinet and the drain pan for providing controlled movement of the drain pan between an operational position, in which the drain pan is within two inches of the bottom panel, and a maintenance position, in which the drain pan is at least ten inches from the bottom panel.

According to yet another illustrative embodiment, a cooling unit for cooling a refrigerated room includes a cabinet having a plurality of panels forming an interior space. The plurality of panels includes a front panel and a bottom panel. The cooling unit further includes a fan aperture formed on the front panel and a fan disposed within the interior space for forcing air out of the fan aperture. The cooling unit further includes a drain pan, which is proximate the bottom panel of the cabinet when in an operational position. The drain pan has a first longitudinal edge and a second longitudinal along a front and a back, respectively. The cooling unit further includes a pivot hinge coupled between the drain pan and the bottom panel along at least a portion of the first longitudinal edge. The pivot hinge includes a spring-controlled lever. The cooling unit further includes at least one selectably releasable fastener coupled to the drain pan along at least a portion of the second longitudinal edge to hold the drain pan proximate the cabinet when in the operational position and to be released to allow the drain pan to pivot about the pivot hinge on the first longitudinal edge such that the drain pan enters a maintenance position. Other cooling units, systems, and methods are disclosed herein.

DESCRIPTION OF THE DRAWINGS

Illustrative embodiments of the present disclosure are described in detail below with reference to the attached drawing figures, which are incorporated by reference herein and wherein.

DETAILED DESCRIPTION

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims.

According to an illustrative embodiment, a cooling unit for use as an aspect of a cooling system such as might be used with a walk-in cooler includes a cabinet. The cabinet is formed by a plurality of panels that include a front panel and a bottom panel. The front panel has one or more fan apertures through it that accommodate at least a portion of fan. The fan moves air from the interior of the cabinet outward. The air moved outward has been cooled by a heat exchanger, for example an evaporator, within the cabinet. Underneath the bottom panel is a drain pan.

The drain pan is coupled to the cabinet by guide-rail slide and track assemblies. These assemblies allow the drain pan to be lowered from an operational position, or closed position, to a maintenance position, or open position, by a single technician, and upon completion of servicing, to be returned to the operational position by a single technician. The cooling unit may further include a controlled movement device, such as a gas spring or gear drive, that assists in keeping the movement of the drain pan from the operational position to the maintenance position controlled and smooth. Unless otherwise indicated, as used throughout this document, "or" does not require mutual exclusivity. Other embodiments, features, and aspects are contemplated as will be clear based on the following.

Figure 1:
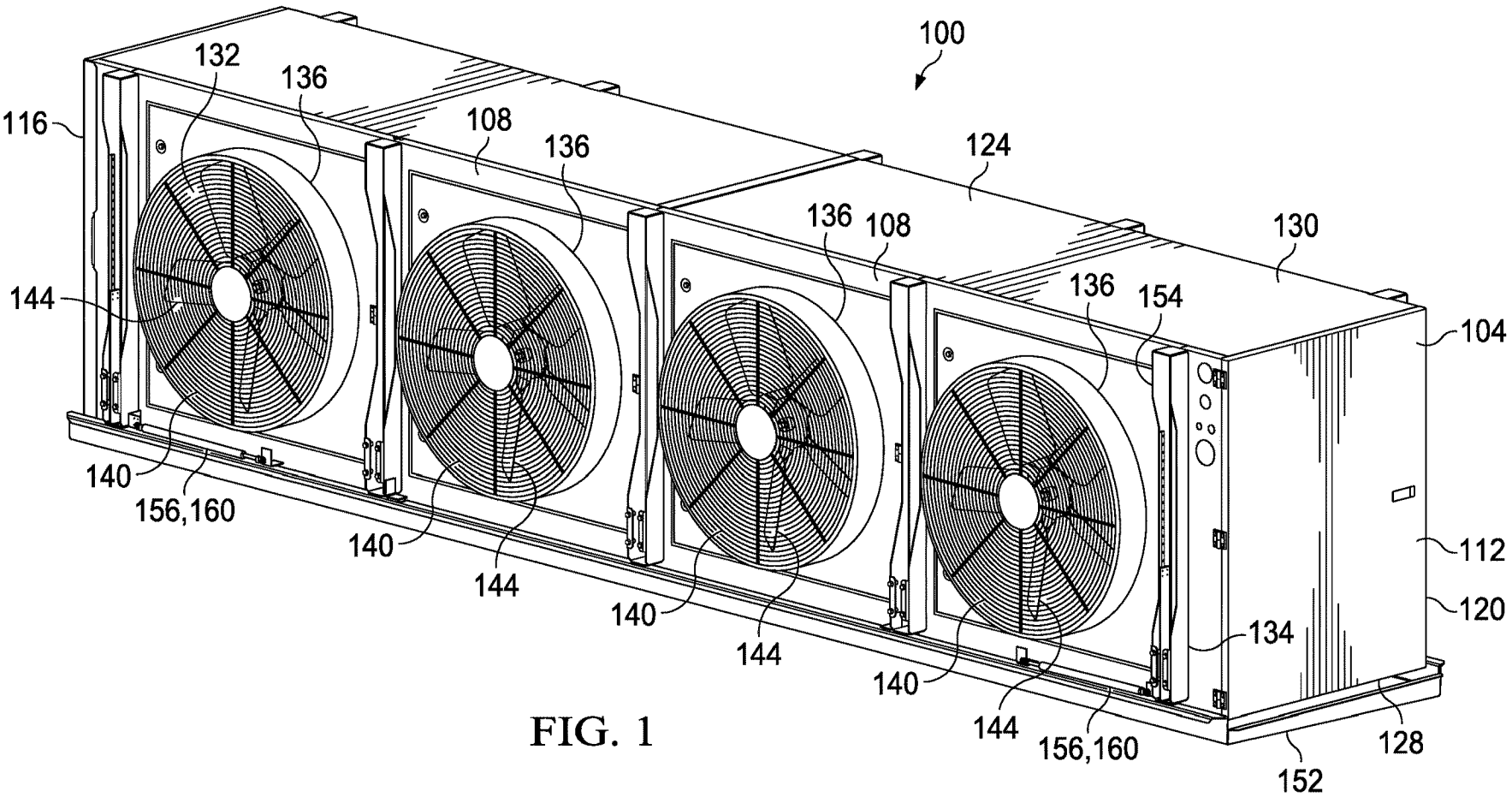
FIG. 1 is a schematic, perspective view of an illustrative embodiment of a cooling unit for use as part of a refrigeration system or other HVAC system according to an aspect of the present disclosure.

Referring now to the figures and initially to FIG. 1, a cooling unit 100 according to one illustrative embodiment is shown in a perspective view. The cooling unit 100 may be mounted near the ceiling of a walk-in cooler (see FIG. 2) or may be supported by structural posts coupled to the cabinet and resting on the floor or otherwise positioned in a space to be cooled. The cooling unit 100 includes a plurality of panels 104 that includes a front panel 108, a first side, end panel 112, a second end panel 116, a back panel 120, a top panel 124, and a bottom panel 128. In this embodiment for the orientation shown, the front panel, side, end panels 112, 116, and back panel 120 are vertical side walls or panels. The plurality of panels 104 are coupled to form a cabinet 130 having an interior, or interior space 132.

Figure 7:
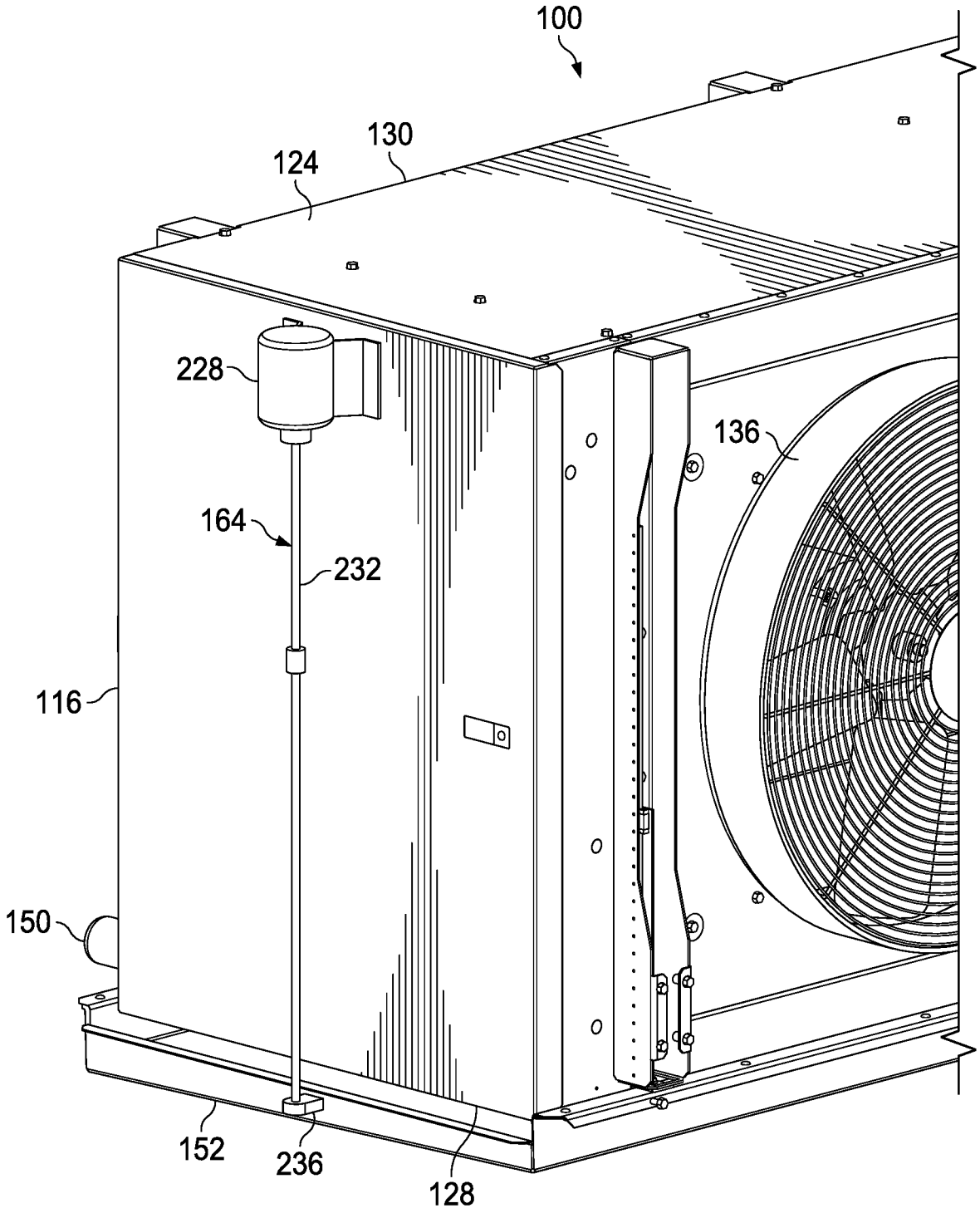
FIG. 7 is a schematic, perspective view of a portion of another illustrative embodiment of a cooling unit for use as part of a refrigeration system or other HVAC system according to an aspect of the present disclosure in an operational position.

The front panel 108 is formed with one or more fan apertures 136, which may be covered with a fan guard 140. Proximate each fan aperture 136 is a fan 144 that is at least partially within the interior 132—at least the fan drive shaft (see FIG. 9). FIG. 1 shows four fans 144, but any number might be used. The fan 144 is used to pull air out of the interior 132 through the fan aperture 136 and into the surrounding space to be cooled, e.g., walk-in cooler. The interior 132 includes a heat exchanger 148 (FIG. 2), e.g., an evaporator, over which the air moves before being discharged by the fan 144. The heat exchanger 148 may be coupled to a closed refrigerant line 150 (FIG. 7).

Underneath the bottom panel 128 is a drain pan 152. The drain pan may be used to collect condensation or any fluids that may be produced and find their way to the drain pan. In an operational position, the drain pan 152 is proximate the bottom panel 128—typically touching or at least within two or three inches of the bottom panel 128. At times, the drain pan 152 must be moved out of the way for maintenance or other servicing of the cooling unit 100. In the past this may have required multiple technicians and considerable time and work to remove a drain pain. In this illustrative embodiment, the drain pan 152 may be easily moved out of the way by a single technician.

The drain pan 152, as will be described further below in more detail, may move in a limited fashion relative to the cabinet 130 between the operational position (as shown in FIG. 1) and a maintenance position (see, e.g., FIGS. 4 and 5) with the assistance of guide-rail slide and track assemblies 154. The cooling unit 100 may also include a controlled movement device 156, which may comprise a gas spring 160, a gear drive assembly 164 (FIG. 7), a chain, or a steel spring. The controlled movement device 156 is coupled between the cabinet 130 and the drain pan 152 relative to the cabinet 130.

Figure 2:
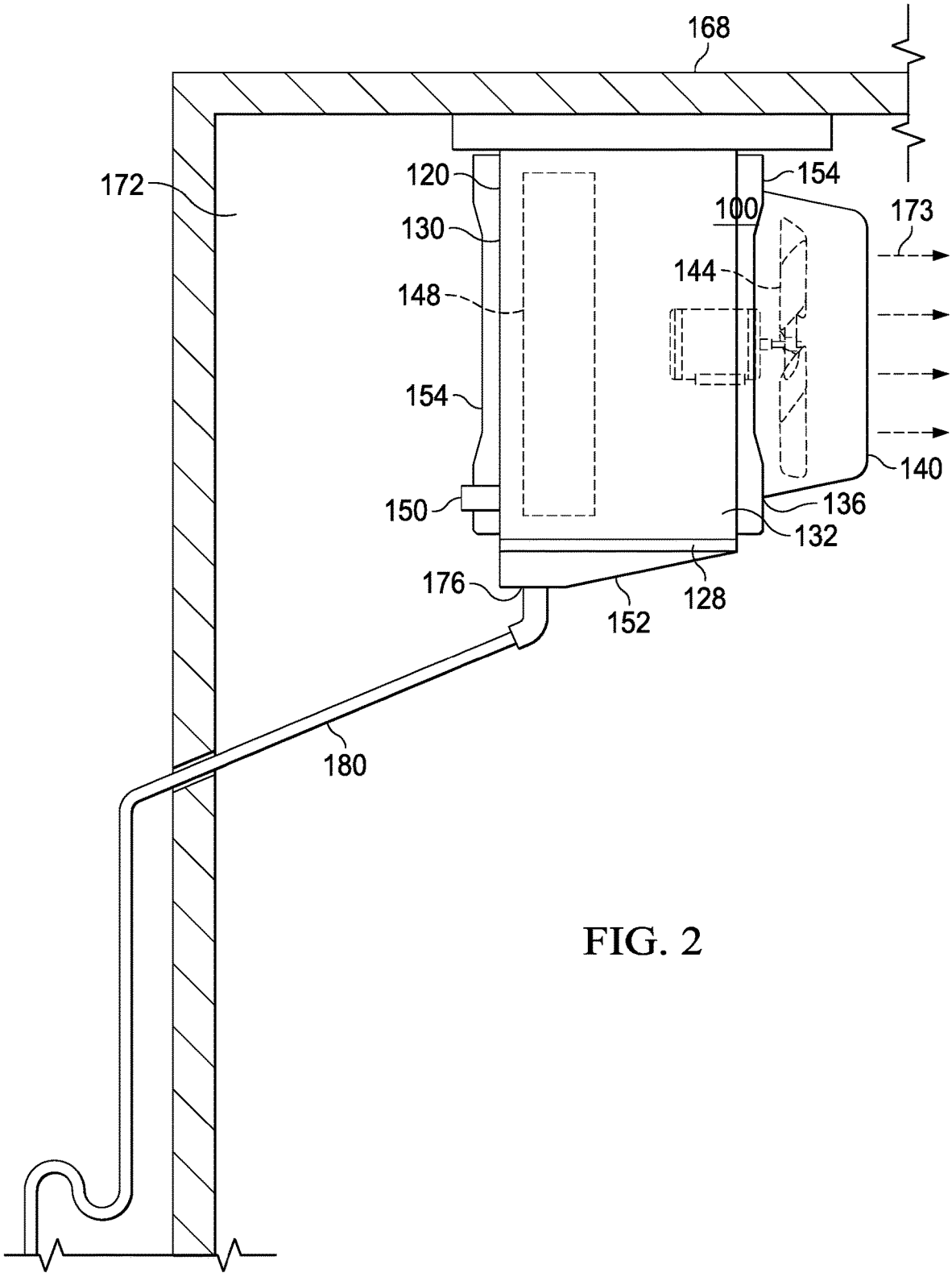
FIG. 2 is a schematic, elevation view with a portion shown in cross-section of an illustrative embodiment of an cooling unit for use as part of a refrigeration system or other HVAC system according to an aspect of the present disclosure, shown mounted in a walk-in cooler.

Referring now primarily to FIG. 2, another illustrative embodiment of a cooling unit 100 is presented that is analogous to the cooling unit 100 of FIG. 1. The cooling unit 100 of FIG. 2 is mounted near a ceiling 168 of a walk-in cooler room 172. In this side view, the fan 144 is shown at least partially within the interior 132. Airflow 173 is shown being discharged through the fan aperture 136. The drain pan 152 may be flat or angled as shown to help direct liquids to a drain aperture 176, or drain, and an associated drain line 180. The drain pain 152 is shown touching the bottom panel 128, but it could be an inch, two inches, or three inches from the bottom panel 128 of the cabinet 130 when in the operational position as shown. A plurality of guide-rail slide and track assemblies 154 helps provide controlled movement of the drain pan 152 relative to the cabinet 130.

Figure 3:
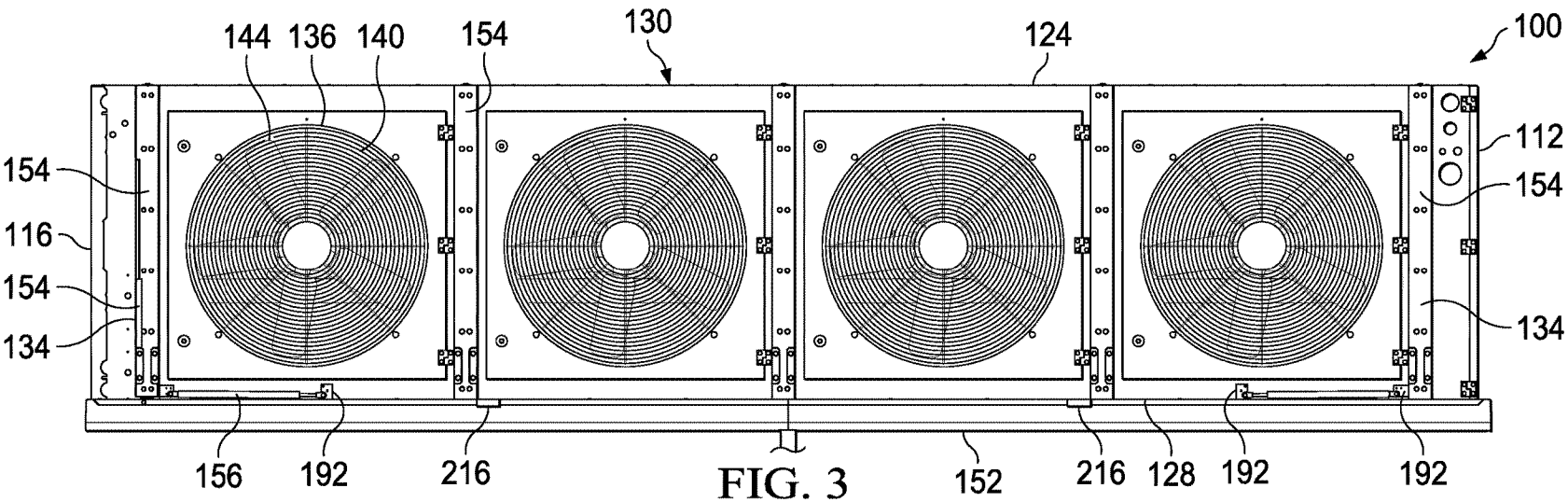
FIG. 3 is a schematic, elevation view of an illustrative embodiment of a cooling unit for use as part of a refrigeration system or other HVAC system according to an aspect of the present disclosure in an operational position.
Figure 4:
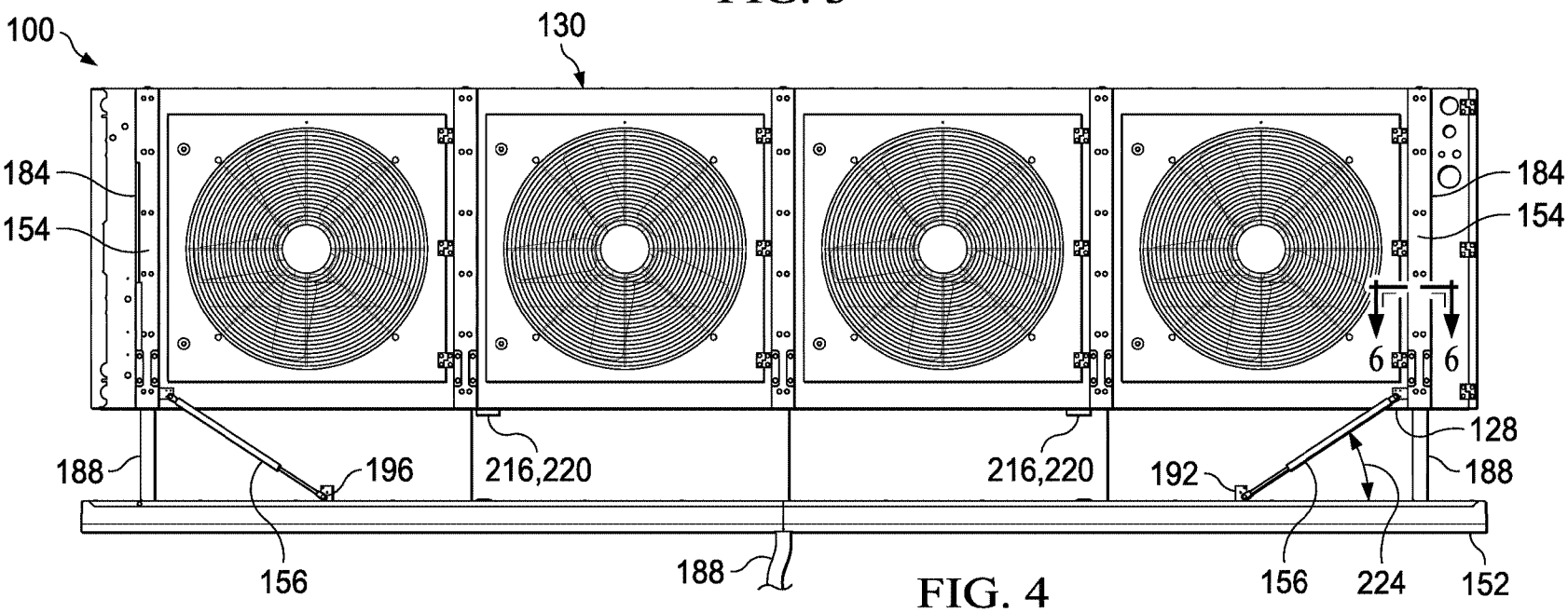
FIG. 4 is a schematic, elevation view of an illustrative embodiment of the cooling unit of FIG. 3 shown in a maintenance position.
Figure 5:
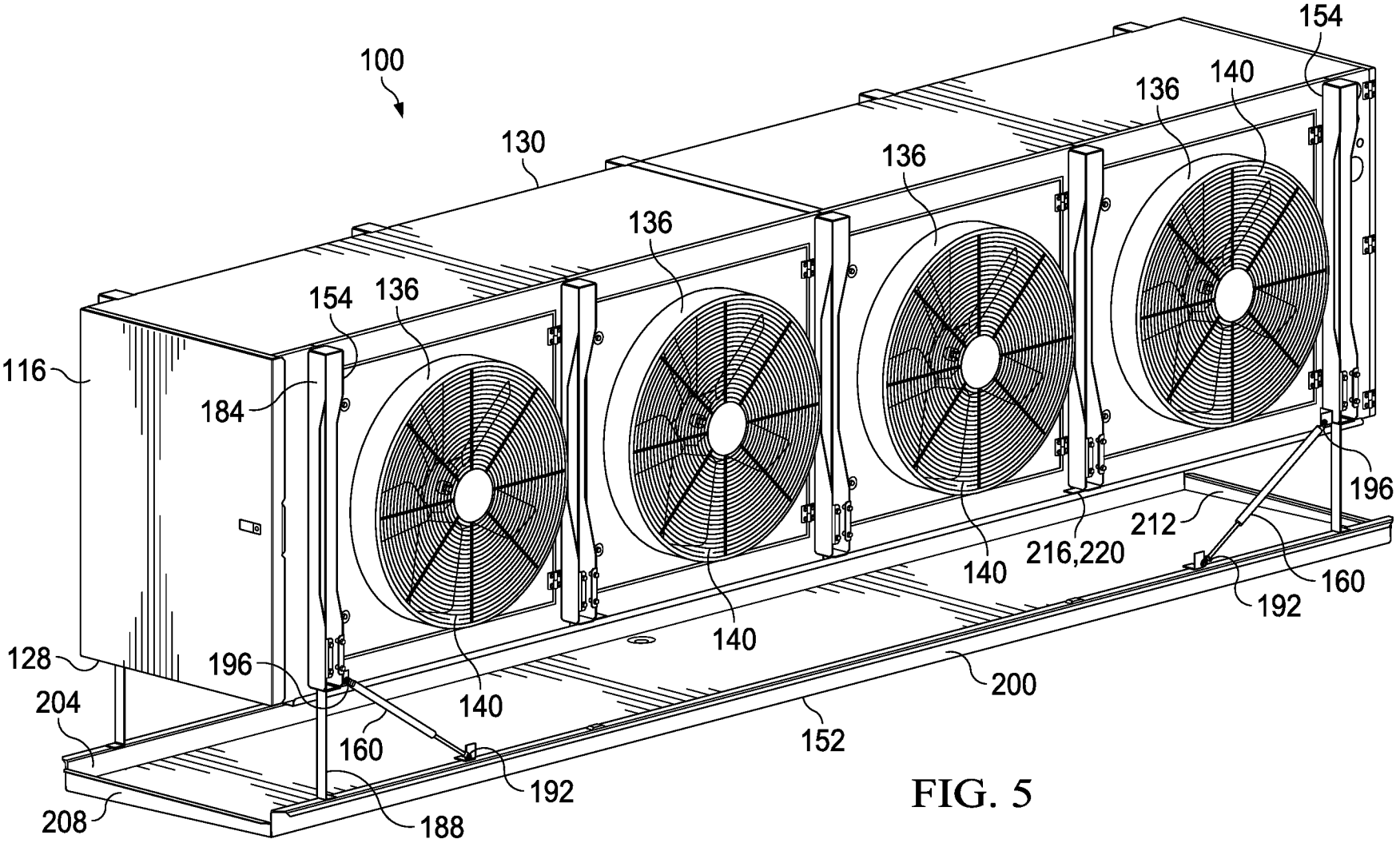
FIG. 5 is a schematic, perspective view of the cooling unit of FIGS. 3 and 4.

Referring now primarily to FIGS. 3-5, an illustrative embodiment of a cooling unit 100 is presented. The cooling unit 100 of FIGS. 3-5 is analogous in many respects to the cooling units 100 of FIGS. 1 and 2.

FIG. 3 shows the cooling unit 100 with the drain pan 152 in the operational position. In this position, the drain pan 152 is touching or at least within a few inches of the bottom panel 128. FIGS. 4 and 5 show the drain pan 152 in a maintenance position, or open position. In the maintenance position, the drain pan 152 has been moved away from the bottom panel 128 sufficiently to allow the technician to gain access to the bottom panel 128. In some embodiments, the drain pan 152 is at least 10 to 15 inches away from the bottom panel 128 in the maintenance position. A distance traveled by the drain pan 152 in going from the operational position to the maintenance position is at least ten inches and in some embodiments 12 or more inches.

Figure 6:
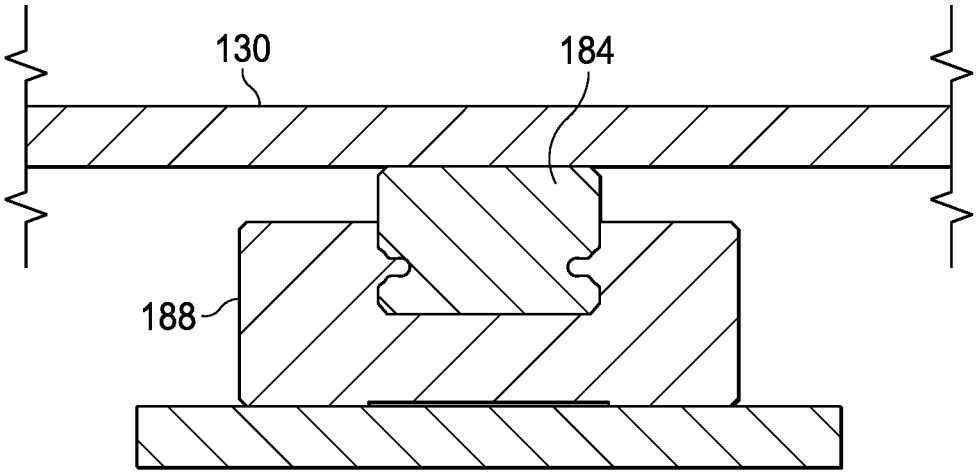
FIG. 6 is a schematic cross-section of a guide-rail slides and tracks assembly taken along line 6-6 in FIG. 4.

The guide-rail slide and track assemblies 154 may be used for providing controlled movement of the drain pan 152 between the operational position and the maintenance position. The guide-rail slide and track assemblies 154 are coupled between at least a portion of the cabinet 130 (which includes coupling to the hangar brackets 134) and the drain pan 152. Coupling includes forming as part of the item. Each guide-rail slides and tracks assembly 154 may include a guide receptacle or track 184 and a guide rail slide 188. See also FIG. 6. Those skilled in the art will appreciate that the guide receptacle or track 184 may be coupled to the drain pain 152 and the guide rail slide 188 could be coupled to the cabinet 130, or vice versa. Moreover, any number of guide-rail slide and track assemblies 154 may be used that allow for controlled relative movement. In one embodiment, the guard-rail slides and tracks assemblies 154 are embedded in, or formed as part of, the hanger bracket 134 used to support the cabinet 130.

Given the weight and complexity of lowering the drain pan 152 with a single technician, the controlled movement device 156 may be used. The controlled movement device 156 may be any device that controls, e.g. slows, the movement of the drain pain 152 relative to the cabinet 130, and may in some embodiments help with raising the drain pan 152 back into the operational position. The controlled movement device 156 may help prevent the sudden drop of the drain pan 152 when a selectable releasable fastener (e.g., 216) is opened. The controlled movement device 156 may include a gas spring 160 (FIGS. 1, 3-5), a gear drive (FIG. 7), a chain, a steel spring, or in other embodiments a pivot hinge (see FIG. 10). The controlled movement device 156 is coupled between the cabinet 130 and the drain pan 152.

The controlled movement device 156 in FIG. 3-5 is a telescoping gas spring 160 having a first end 192 and a second end 196. The first end 192 is coupled to the drain pain 152 and the second end is coupled to the cabinet 130. As used herein, the "coupling" to the cabinet 130 would also include coupling to an attachment to the cabinet 130, such as to the hangar bracket 134. In the maintenance position, or open position, the gas spring 160 may form an angle 224 (FIG. 4) relative to the drain pan 152 when in the maintenance position of between 30 and 60 degrees or any angle in that range.

Referring now primarily to FIG. 5, which shows the drain pan 152 lowered to the maintenance position away from the bottom panel 128, one may see that the drain pan 152 has a first longitudinal edge 200 on a front and a second longitudinal edge 204 on a back. The drain pan 152 also has a first lateral edge 208 and a second lateral edge 212. Now with references to FIG. 4 again, one or more of the edges 200, 204, 208, 212 interact with one or more selectably releasable fasteners 216 that are operative to hold the drain pan 152 touching or close (within a few inches) to the cabinet 130. The magnetic catcher and fasteners may be integrated with the hanger brackets in some embodiments. In the illustrative embodiment, the selectably releasable fasteners 216 comprise a magnetic catch 220. The magnetic catch 220 includes a magnet on either the cabinet 130 or the drain pan 152 and a complimentary magnetically-attracted material on the other member, e.g., the opposing cabinet 130 or drain pan 152. In other embodiments, the selectably releasable fasteners 216 may be a latch, a lever-type lock, or a quickly removable screw. In some embodiments, one or more selectably releasable fasteners 216 may be used; for example, in one embodiment, a latch may be used and in addition magnetic catches may be used so that the drain pan 152 does not drop immediately when the latch is opened so that the drain pan 152 would only lower when additional force is added.

Referring now primarily to FIG. 7, another illustrative embodiment of a cooling unit 100 is presented. The cooling unit 100 is analogous to those that have been described above, but in this embodiment the drain pan 152 is raised and lowered using the guide-rail slide and track assemblies 154 with a gear drive 164, which includes a motor 228 coupled to the cabinet 130. The motor 228 may be coupled, for example, on an end panel 116 near a top portion or elsewhere. The motor 228 is connected to a pinion and screw rail 232 and the pinion and screw rail 232 is coupled at one end to the drain pan 152 directly or by a coupling arm 236. When the motor 130 is driven in a first direction, e.g., clockwise, the drain pan 152 moves upward and when moved the other direction, e.g., counter-clockwise, the drain pan 152 moves downward. Thus, a stepper motor ball screw/lead screw may automatically raise and lower the drain pan 152. A parallel motor may be included on the other end of the cabinet 130 in some embodiments.

Figure 8:
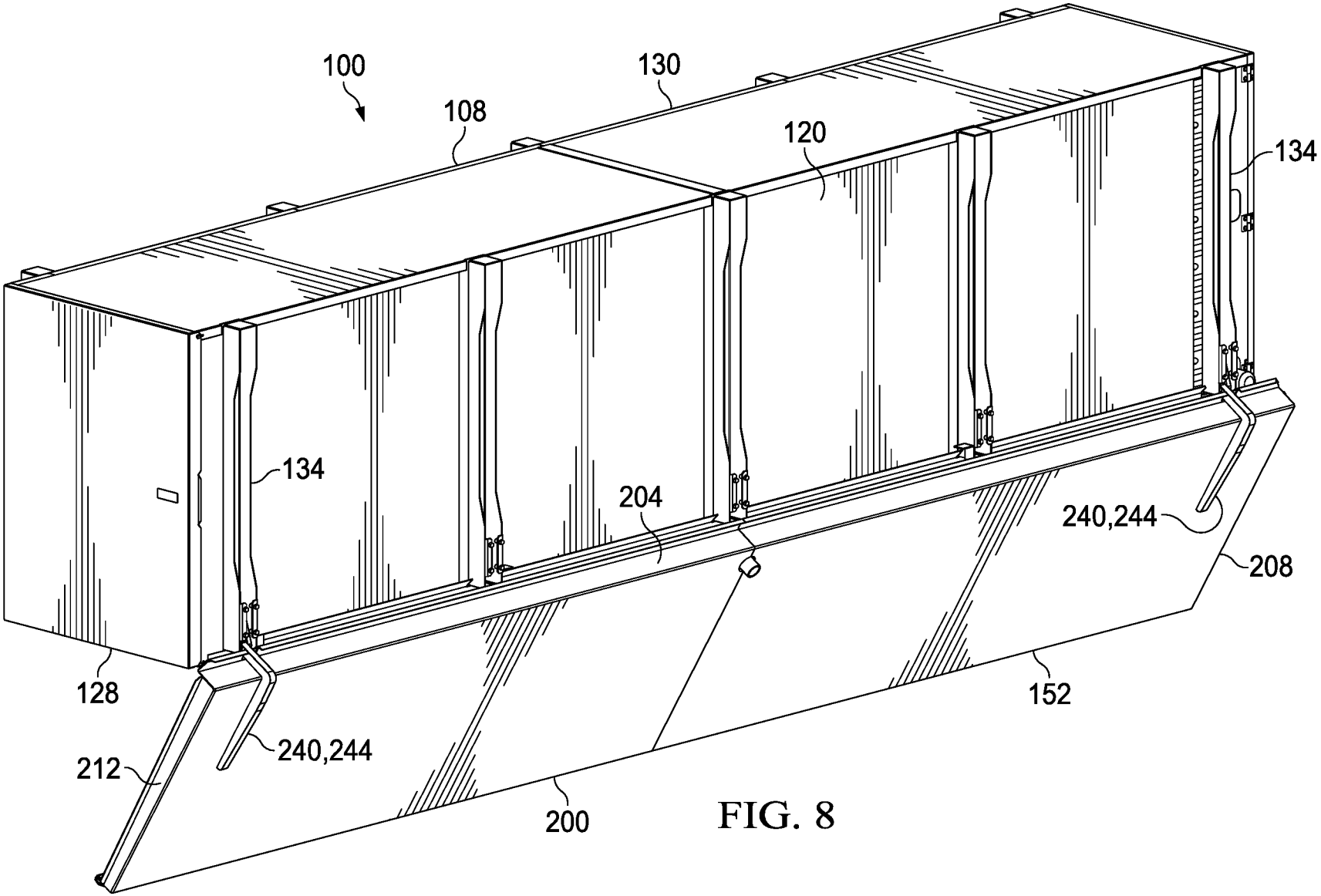
FIG. 8 is a schematic, perspective view of another illustrative embodiment of a cooling unit for use as part of a refrigeration system or other HVAC system according to an aspect of the present disclosure shown in a maintenance position.
Figure 9:
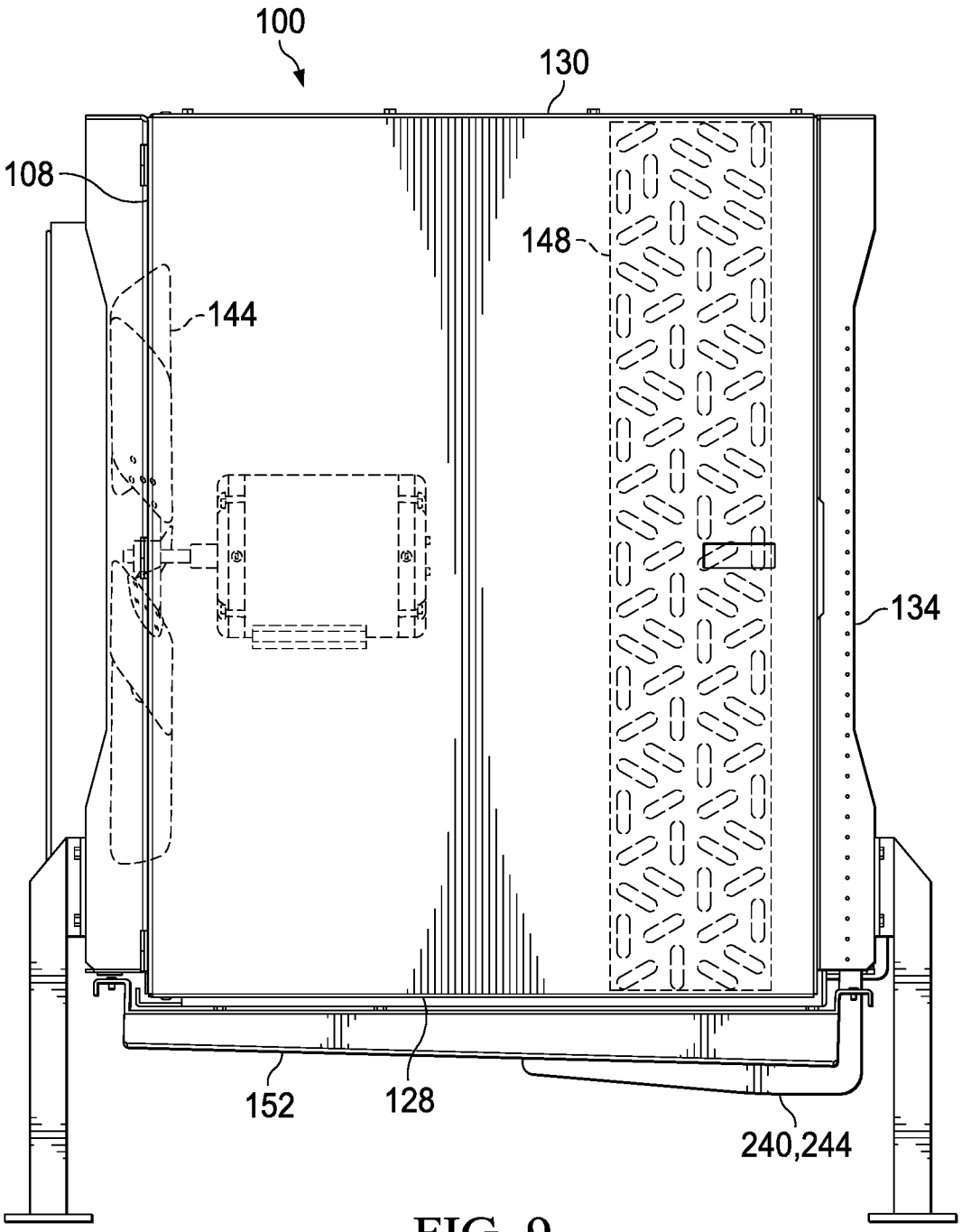
FIG. 9 is a schematic elevation view of one end of the cooling unit of FIG. 8 shown in an operational position.
Figure 10:
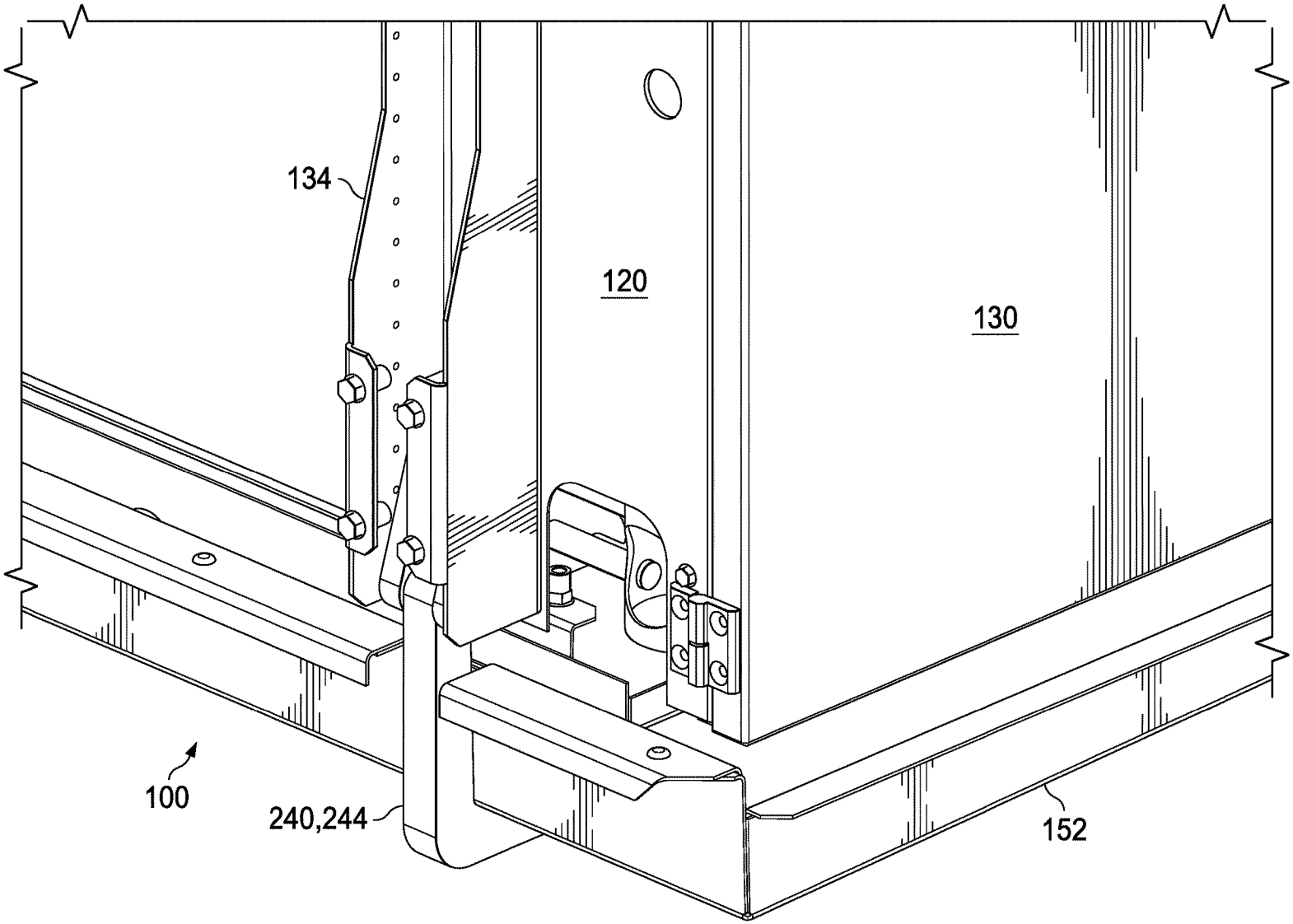
FIG. 10 is a schematic, perspective view of a lower corner portion of the cooling unit of FIGS. 8 and 9.

Referring now primarily to FIGS. 8-10, an alternative embodiment of a cooling unit 100 is presented. In this embodiment, one or more pivot hinges 240 are coupled between the cabinet 130 (which as used herein includes hangar brackets 134) and the drain pan 152 along the second longitudinal edge 204 (which may include a side brace). The pivot hinge 240 may comprise a spring-controlled lever 244 coupled to the hangar bracket 134 and extending under and coupled to the drain pan 152. The spring aspect of the spring-controlled lever 244 allows for the drain pan to be slowly lowered (angled) and raised by a single technician to put the drain pan 152 in the maintenance position. In this embodiment, the maintenance position is when the drain pan 152 is swung open (angled) to expose most of the bottom panel 128. At least one selectably releasable fastener 216 (see FIGS. 3-5) is coupled to the drain pan 152 along at least a portion of the second longitudinal edge 200 to hold the drain pan 152 proximate the cabinet 130 when in the operational position and to be released to allow the drain pan 152 to pivot about the pivot hinge 240 on the first longitudinal edge 204 such that the drain pan 152 enters the maintenance position.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A cooling unit for cooling a refrigerated room, the cooling unit comprising:

a cabinet having a plurality of panels forming an interior space;

an evaporator coil disposed within the interior space;

wherein the plurality of panels comprises a bottom panel and a front panel;

a fan aperture formed in the front panel of the cabinet for allowing discharge of an airflow;

a drain pan, which is moveable between at least two positions, and wherein the drain pan is at least within three inches of the bottom panel of the plurality of panels of the cabinet when in an operational position;

wherein the drain pan has a first longitudinal edge and a second longitudinal edge along a front and a back respectively;

a plurality of guide-rail slides and tracks coupled to the drain pan and to another portion of the cabinet, wherein the guide-rail slides and tracks are configured to allow limited relative movement of the drain pan between the operational position and a maintenance position, wherein in the maintenance position the drain pan is at least ten inches from the bottom panel of the cabinet;

at least one telescoping gas spring coupled at a first end to the drain pan and at the other end to a portion of the cabinet and configured to support the drain pain and allow the drain pan to move between the operational position and the maintenance position slower than the drain pan would otherwise move between the operative position and maintenance position;

at least one selectably releasable fastener coupled to the drain pan and another portion of the cabinet to hold the drain pan proximate the cabinet when in the operational position and to be released to allow the drain pan to move on the guide rail slides to the maintenance position; and wherein a distance traveled by the drain pan in going from the operational position to the maintenance position is at least ten inches.

2. The cooling unit of claim 1, wherein in the operational position the drain pan is within at least one inch of the cabinet.

3. The cooling unit of claim 1, wherein in the operational position the drain pan is touching the cabinet.

4. The cooling unit of claim 1, wherein in the operational position the drain pan is within at least one inch of the cabinet, and wherein in the maintenance position the drain pan is at least twelve inches from a bottom panel of the cabinet.

5. The cooling unit of claim 1, wherein the plurality of guide-rail slides and tracks comprises a plurality of guide rail tracks coupled to the cabinet and a plurality of guide rail slides that are coupled to the drain pan, and wherein the guide rail slides slideably engage the guide rail tracks.

6. The cooling unit of claim 1, wherein the plurality of guide-rail slides and tracks comprises a plurality of guide rail slides coupled to the drain pan and a plurality of guide rail tracks that are coupled to the cabinet, and wherein the guide rail slides slideably engage the guide rail tracks.

7. The cooling unit of claim 1, wherein the at least one selectably releasable fastener comprises a magnetic catch having a magnet on either the cabinet or the drain pan or vice versa and a complimentary magnetically-attracted material on an other of the cabinet or drain pan.

8. The cooling unit of claim 1, wherein the at least one selectably releasable fastener is a latch.

9. The cooling unit of claim 1, wherein the at least one selectably releasable fastener comprises a magnetic catch having a magnet on either the cabinet or the drain pan or vice versa and a complimentary magnetically-attracted material on the other of the cabinet or drain pan;

wherein in the operational position the drain pan is within at least one inch of the cabinet, and wherein in the maintenance position the drain pan is at least twelve inches from a bottom panel of the cabinet; and wherein the at least one telescoping gas spring forms an angle between 30 and 60 degrees relative to the drain pan when in the maintenance position.

10. A cooling unit for cooling a walk-in cooler, the cooling unit comprising:

a cabinet, wherein a plurality of vertical side panels, a top panel, and a bottom panel are coupled to form the cabinet, and wherein one of the plurality of vertical side panels is formed with a fan aperture;

a fan disposed proximate the fan aperture;

a heat exchanger disposed within the cabinet such that an airflow moved by the fan interacts with the heat exchanger before being discharged from the cabinet through the fan aperture;

a drain pan, which is moveable between at least two positions, and wherein the drain pan is positioned underneath and proximate to the bottom panel when in an operational position;

a plurality of guide-rail slide and track assemblies cooperatively coupled to the drain pan and to the cabinet to provide vertical movement of the drain pan relative to the cabinet between the operational position and a maintenance position in which the drain pan is at least twelve inches from the bottom panel;

at least one fastener for selectively holding the drain pan in the operational position when fastened; and a gas spring coupled to the cabinet and to the drain pan for providing controlled movement of the drain pan relative to the bottom panel between the operational position and the maintenance position when the at least one fastener is released.

11. The cooling unit of claim 10, wherein the gas spring forms an angle of between 30 and 60 degrees relative to the drain pan when the drain pan is in the maintenance position.

12. The cooling unit of claim 10, wherein the at least one fastener comprises a magnetic catch having a magnet on either the cabinet or the drain pan or vice versa and a complimentary magnetically-attracted material on the other of the cabinet or drain pan.

13. A cooling unit for use as an aspect of a cooling system, the cooling unit comprising:

a cabinet comprising a plurality of panels and having an interior, a front face with a fan aperture formed in the front face, and a bottom panel;

an evaporator coil disposed within the interior of the cabinet;

a drain pan below the bottom panel, the drain pan having a drain for coupling to a drain line, wherein the drain pan is moveable between at least two positions: an operational position and a maintenance position; and a plurality of guide-rail slide and track assemblies coupled between at least a portion of the cabinet and the drain pan for providing controlled movement of the drain pan between the operational position, in which the drain pan is within two inches of the bottom panel, and the maintenance position, in which the drain pan is at least ten inches from the bottom panel.

14. The cooling unit of claim 13, further comprising a controlled movement device consisting of at least one of the following: a gas spring, a gear drive, a chain, and a steel spring; and wherein the controlled movement device is coupled between the cabinet and the drain pan.

15. The cooling unit of claim 14, wherein the controlled movement device comprises a gas spring; and wherein the gas spring forms an angle between 30 and 60 degrees relative to the drain pan.

16. The cooling unit of claim 14, wherein the controlled movement device comprises a gas spring; and wherein the gas spring forms an angle between 40 and 50 degrees relative to the drain pan.

17. The cooling unit of claim 13, further comprising at least one selectably releasable fastener coupled between the cabinet and the drain pan for securing the drain pan in the operational position when fastened and allowing the drain pan to move in association with the guide-rail slide and track assemblies when unfastened.

18. The cooling unit of claim 13, further comprising a controlled movement device consisting of at least one of the following: a gas spring, a gear drive, a chain, and a steel spring; and at least one selectably releasable fastener coupled between the cabinet and the drain pan for securing the drain pan in the operational position when fastened and allowing the drain pan to move in association with the guide-rail slide and track assemblies when unfastened to the maintenance position.

19. The cooling unit of claim 13, wherein, in the operational position the drain pan is within one inch of the bottom panel, and wherein in the maintenance position the drain pan is at least twelve inches from the cabinet.

20. The cooling unit of claim 13, further comprising:

a controlled movement device consisting of at least one of the following: a gas spring, a gear drive, a chain, and a steel spring;

at least one selectably releasable fastener coupled between the cabinet and the drain pan for securing the drain pan in the operational position when fastened and allowing the drain pan to move in association with the guide-rail slide and track assemblies when unfastened to the maintenance position; and wherein, in the operational position the drain pan is within one inch of the bottom panel, and wherein in the maintenance position the drain pan is at least twelve inches from the cabinet.

* * * * *